US006519961B2

(12) United States Patent
Schill

(10) Patent No.: US 6,519,961 B2
(45) Date of Patent: Feb. 18, 2003

(54) FLAKE ICE MACHINE

(75) Inventor: Joachim Schill, Kehl-Goldscheuer (DE)

(73) Assignee: Maja-Maschinenfabrik Hermann Schill GmbH & Co. KG, Kehl-Goldscheur (DE)

( * ) Notice: Subject to any disclaimer, the term of this patent is extended or adjusted under 35 U.S.C. 154(b) by 0 days.

(21) Appl. No.: 09/980,787

(22) PCT Filed: Apr. 10, 2001

(86) PCT No.: PCT/DE01/01399

§ 371 (c)(1),
(2), (4) Date: Dec. 6, 2001

(87) PCT Pub. No.: WO01/77592

PCT Pub. Date: Oct. 18, 2001

(65) Prior Publication Data

US 2002/0174668 A1 Nov. 28, 2002

(30) Foreign Application Priority Data

Apr. 11, 2000 (DE) ..... 100 17 723

(51) Int. Cl.[7] ..... F25C 1/14
(52) U.S. Cl. ..... 62/233; 62/354
(58) Field of Search ..... 62/233, 354, 188

(56) References Cited

U.S. PATENT DOCUMENTS

| | | | | | |
|---|---|---|---|---|---|
| 2,308,541 | A | * | 1/1943 | Raver | 62/346 |
| 2,749,722 | A | * | 6/1956 | Knowles | 62/346 |
| 3,733,840 | A | * | 5/1973 | Pearl et al. | 165/267 |
| 4,538,428 | A | * | 9/1985 | Wilkerson | 165/94 |
| 4,662,183 | A | * | 5/1987 | Keller | 62/138 |
| 4,986,081 | A | * | 1/1991 | Hida et al. | 62/130 |
| 5,027,610 | A | * | 7/1991 | Hara | 62/135 |
| 5,325,679 | A | | 7/1994 | Tatematsu | |
| 5,477,694 | A | | 12/1995 | Black | |
| 5,813,238 | A | | 9/1998 | Lee | |

FOREIGN PATENT DOCUMENTS

| | | |
|---|---|---|
| DE | 89 12 336 | 2/1990 |
| DE | 91 16 102 | 2/1992 |
| DE | 94 12 825 | 12/1994 |
| DE | 198 26 006 | 12/1998 |
| DE | 197 35 598 | 2/1999 |
| DE | 299 18 674 | 12/1999 |
| EP | 04 79 032 | 4/1992 |
| EP | 05 04 735 | 9/1992 |

* cited by examiner

*Primary Examiner*—William E. Tapolcai
(74) *Attorney, Agent, or Firm*—Paul Vincent

(57) ABSTRACT

A flake ice machine and a method for the monitoring of a flake ice machine are disclosed. On opening the water inlet valve a clock is started and, after a certain filling time, the water inlet valve is closed, even if a sensor (6) in the evaporator trough (2) has not detected reaching the maximum fill level.

10 Claims, 2 Drawing Sheets

FLAKE ICE MACHINE

BACKGROUND OF THE INVENTION

The invention concerns a flake ice machine and a method for monitoring a flake ice machine.

Flake ice machines produce relatively thin flake ice for keeping food fresh, in particular in the meat industry. The cooled evaporator roller is immersed into the water of the evaporator trough. When the evaporator roller turns, the amount of water carried along by its jacket freezes. The ice layer thereby produced is released from the jacket of the evaporator roller by a means provided on the roller, e.g. a scraper, before renewed immersion into the water. This is effected either by scraping or cracking. The evaporator roller contains a refrigerant which is connected to a refrigerator located outside of the roller. A control means is provided for monitoring and controlling the evaporator roller, the refrigerator and the water inlet valve. To prevent damage to the flake ice machine or the evaporator trough due to overflow caused by malfunction, the control means monitors the filling time, ice production and water fill level in the evaporator trough. If predetermined thresholds are exceeded or fallen below, the water inlet valve, the drive of the evaporator roller or the refrigerator are switched off and the user receives an error message.

A sensor has been conventionally used to monitor the water fill level in the evaporator trough. If a maximum water fill level is detected, the control means triggers the closing of the water inlet valve. The water fill level in the evaporator trough decreases due to ice production. If the sensor detects a minimum water fill level in the evaporator trough, the water inlet valve is opened and the water fill level in the evaporator trough increases. This process is repeated as often as necessary. If the sensor is defective, the maximum water fill level is not detected and the water inlet valve is not closed, as a result of which the evaporator trough can overflow. If the user is not aware of this situation, serious water damage can result.

The temporal change of the water fill level has also been conventionally monitored. If the water fill level does not change within a predetermined time interval, the flake ice machine is defective. Possible defects are stoppage of the roller, freezing of the roller, a defect in the water fill level sensor, the water inlet valve or the water inlet. Monitoring of one value, namely the temporal change of the water fill level permits detection of all these defects, however, the cause of the error initially remains unknown and must be additionally determined.

SUMMARY OF THE INVENTION

In contrast thereto, the inventive flake ice machine and the inventive method have the advantage that the opening time of the water inlet valve is limited by a clock. The clock is started when the water inlet valve is opened. The water inlet valve is closed if either the sensor detects the maximum water fill level or when a predetermined filling time has elapsed. The filling time is set such that, when the flake ice machine operates faultlessly, filling up to the maximum water fill level is possible and the evaporator trough cannot overflow within the filling time. If the water inlet valve is switched off due to expiration of the filling time, the user receives an error message. In this case, either the sensor for determining the maximum water fill level or the water inlet valve is defective or water inlet does not occur for other reasons.

In an advantageous embodiment of the invention, the minimum water fill level can also be monitored in addition to monitoring the maximum water fill level. Towards this end, the clock is started when the water inlet valve closes. When the flake ice machine operates properly, the water fill level is reduced when the water inlet valve is closed due to ice production and discharge of the ice flakes. When the minimum water fill level has been reached, the water inlet valve opens again. A minimum sensor is provided for detecting the minimum water fill level. If the minimum water fill level is not detected either because the minimum sensor is defective or due to a halt in ice production, an error message is issued to the user after a predetermined discharge time has elapsed. The user can check the function of the flake ice machine and possibly switch it off.

Monitoring of the flake ice machine is possible not only during operation but also when restarting the flake ice machine after stoppage. In this case, the sensor initially detects whether the evaporator trough is filled to the maximum. If this is the case, the residual water valve opens until the sensor can no longer detect maximum fill level. The residual water valve is needed in order to remove the residual or dirty water in the trough after prolonged flake ice machine stoppage times so that same is not used for the production of ice. Opening of the residual water valve starts operation of a clock. After a predetermined time one checks whether or not the fill level is still at a maximum. If this is the case, the user receives an error message. This error message can be caused by a defective sensor or a defective residual water valve. Faultless function of the residual water valve is necessary in order to satisfy the high requirements for the flake ice machine concerning hygiene, since the flake ice is used in the food industry. As mentioned above, discharge of residual or dirty water must be guaranteed. Conventional flake ice machines do not detect a defect of the residual water valve since only the operating state is monitored. The operating state is not influenced by a defective residual water valve since that valve is not used during operation.

If after stoppage and renewed start of the flake ice machine the maximum fill level is not reached, the water inlet valve is opened and a clock is started. If a predetermined time is exceeded without detecting the maximum fill level, the user receives an error message. Possible causes can be a defective sensor, a defective water inlet valve, or a stoppage of water inlet due to other reasons. Usually, the monitoring intervals when starting the flake ice machine after stoppage are different than those during operation.

This method also checks whether water is present in the evaporator trough when starting the flake ice machine after stoppage. In known methods and devices, a sensor is used which determines the electrical conductivity of the evaporator trough content. Towards this end, e.g. two electrodes which are insulated from the evaporator trough may be provided at the bottom of the evaporator trough thereby utilizing the fact that water conducts electrical current and air acts like an insulator. The inventive method and the inventive device recognize the presence of water in the evaporator trough without checking the conductivity. This eliminates the problems which arise with water types having a low conductance, such as distilled water, and the disadvantages associated with electrolysis of water by the two electrodes.

The inventive method and the inventive device can also be combined with known methods and devices having temporal monitoring of the water fill level. In this case, a defective water inlet, water inlet valve or sensor for determining the maximum or minimum fill level can be detected by the inventive method. If the water fill level does not change with time, either the roller or refrigerator is defective. This permits determination of the source of error. If the above-mentioned method is also used to control the flake ice machine before operation start, complete monitoring of the flake ice machine is ensured.

Float switches are e.g. suitable as sensors for determining the maximum or minimum fill level in the evaporator trough. Advantageously, such switches do not depend on the chemical and physical properties of the liquid to be frozen. A float switch can also detect the maximum and the minimum water fill level. Only one float switch is therefore required in the evaporator trough.

When the minimum level is reached, the water inlet valve is opened with a delay of e.g. 15 seconds. This reduces the water level below the predetermined minimum before renewed water inlet. This assures that changes in the water surface, e.g. the formation of waves, do not repeatedly trigger the contact actuated by the sensor, which would otherwise cause rapid wear of that contact. A delayed closing of the water inlet valve when the maximum has been reached is also possible.

The control means comprises a logic circuit which effects opening or closing of the water inlet valve or of the residual water valve, depending on the situation, and optionally issues an error message to the user.

Further advantages and advantageous embodiments of the invention can be extracted from the following description, the drawing and the claims.

BRIEF DESCRIPTION OF THE DRAWING

The drawing shows one embodiment of the invention which is described in more detail below.

DESCRIPTION OF THE PREFERRED EMBODIMENT

Figure 1:
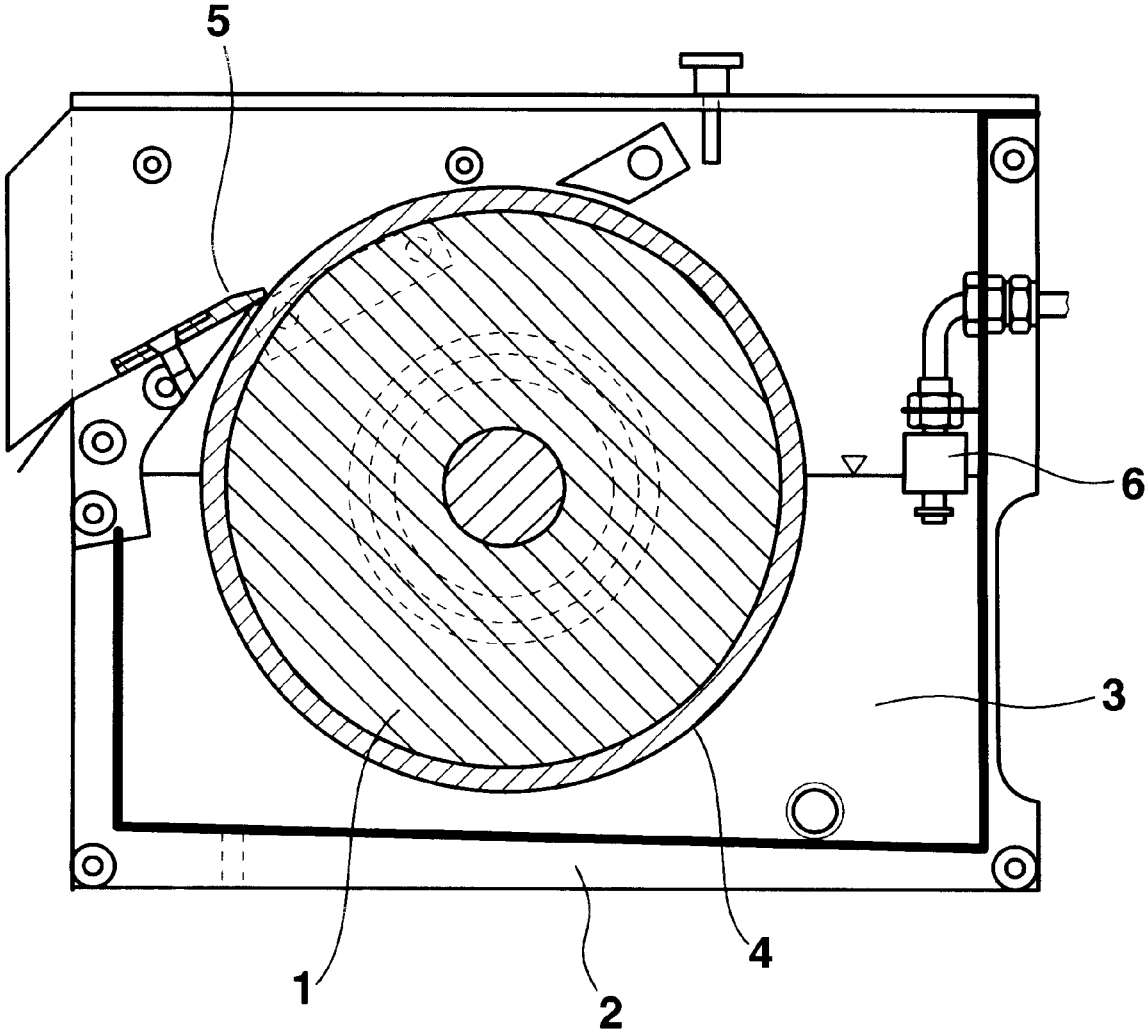
FIG. 1 shows a side view of a flake ice machine

An evaporator roller 1 is rotatably disposed in an evaporator trough 2 of a flake ice machine and rotatably driven by an electric motor or geared engine (not shown). The lower part of the evaporator roller 1 dips into the water 3 which is introduced into the evaporator trough 2 through a water inlet valve (not shown in the drawing). The jacket 4 of the evaporator roller 1 is wetted with water during rotation. The water freezes on the jacket which is cooled by the refrigerator thereby forming a thin ice layer which is removed from the jacket by means of a stationary scraper 5 and guided to a reservoir (not shown). A float switch 6 is disposed on the side of the evaporator trough and dips into the water 3.

Figure 2:
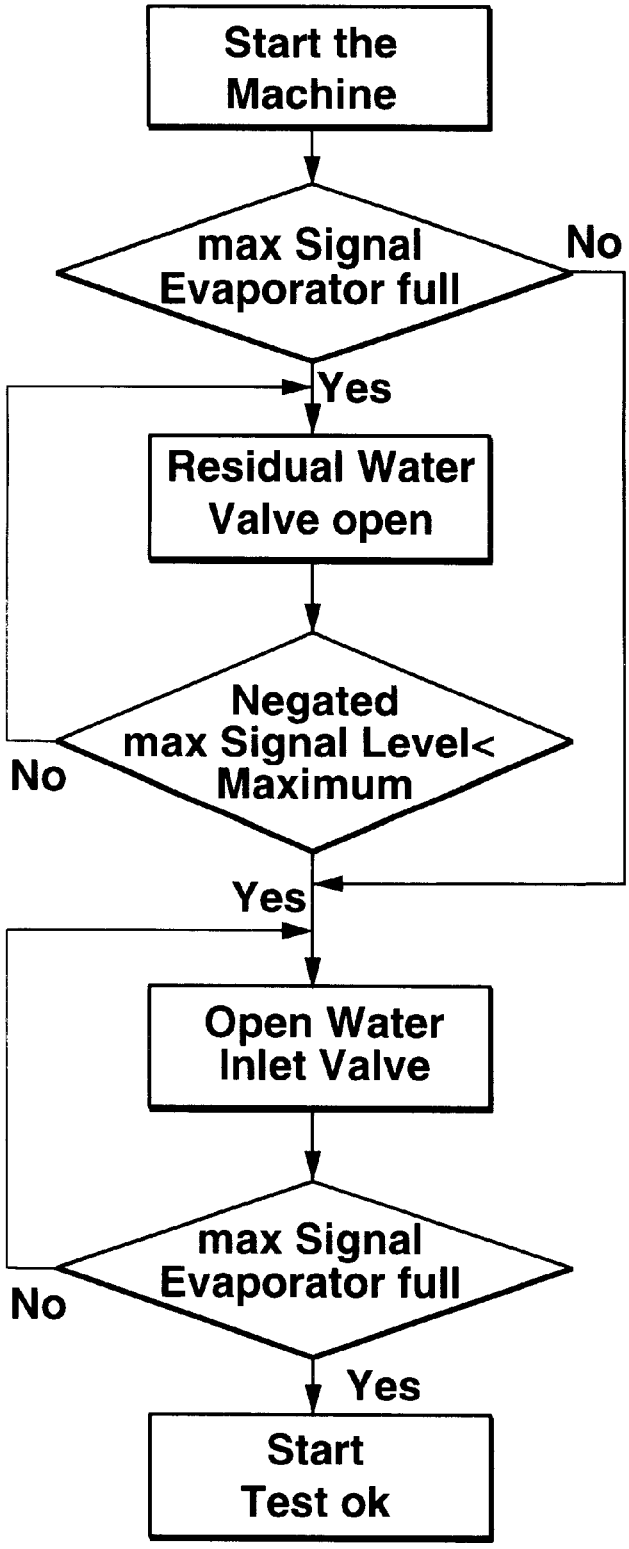
FIG. 2 shows a diagram for monitoring a flake ice machine which is started again after a stoppage.

The diagram of FIG. 2 shows the individual events which are monitored when the flake ice machine is started after stoppage. If the starting test produces no error messages, proper function of the sensor, the water inlet, the water inlet valve and the residual water valve is ensured.

If the flake ice machine is switched off due to lack of water, the starting test shown in FIG. 2 can be repeated in predetermined time intervals of e.g. 15 minutes such that ice production can be automatically continued when water is present again.

All the features shown in the description, the following claims and the drawing may be essential to the invention either individually as well as in any arbitrary combination.

LIST OF REFERENCE NUMERALS

1 Evaporator roller
2 Evaporator trough
3 Water
4 Jacket
5 Scraper
6 Float switch

I claim:

1. A flake ice machine comprising:

a cylindrical evaporator roller;

means for driving said evaporator roller;

a refrigerator for cooling a cooling agent;

means for transferring said cooling agent from said refrigerator through said evaporator roller;

an evaporator trough which can be filled with water and in which said evaporator roller is rotatable disposed;

means for separating the flake ice from an outer jacket of said evaporator roller;

a water inlet valve through which water can be introduced into said evaporator trough;

means for electrically controlling said water inlet valve and at least one of said evaporator roller drive means and said refrigerator;

a sensor for detecting a predetermined maximum water fill level in said evaporator trough; and a clock which is started upon opening of said water inlet valve, wherein said sensor and said clock are connected to said electrical control means to control said water inlet valve.

2. The flake ice machine of claim 1, further comprising a sensor for detecting a predetermined minimum water fill level in said evaporator trough.

3. The flake ice machine of claim 1, wherein said maximum water fill sensor comprises a float switch.

4. The flake ice machine of claim 1, wherein said minimum water fill sensor comprises a float switch.

5. The flake ice machine of claim 1, further comprising a residual water valve disposed on said evaporator trough for emptying said evaporator trough, wherein said residual water valve is connected to said control means.

6. A method for operating the flake ice machine of claim 1, the method comprising the steps of:

a) opening said water inlet valve to inlet water into said evaporator trough;

b) monitoring a water fill level in said evaporator trough using said sensor;

c) starting said clock upon opening of said water fill valve in step a); and d) closing said water fill valve when one of said water fill level reaches said maximum water fill level and said clock elapses a maximum predetermined filling time.

7. The method of claim 6, further comprising issuing an error message to a user if said water inlet valve is closed due to lapse of said filling time.

8. The method of claim 6, further comprising using a sensor to determine whether a minimum water fill level has been reached after closing said water inlet valve, wherein said clock is started upon closing of said water inlet valve and an error message is issued to said user if a predetermined emptying time has elapsed before said minimum water fill level has been detected.

9. The method of claim 6, wherein when the flake ice machine is restarted after stoppage, a sensor determines whether said maximum fill level has been reached, a residual water valve is opened when said fill level is at maximum, and said clock is started upon opening of said residual water valve, wherein, after lapse of a predetermined time, one determines whether or not said maximum fill level is still present and an error message is issued to a user when said fill level is at maximum.

10. The method of claim 6, wherein when the flake ice machine is restarted after stoppage, a sensor determines whether said maximum fill level has been reached, and the water inlet valve is opened when said fill level is below said maximum fill level, wherein a clock is started upon opening of said water inlet valve and said water inlet valve is closed when one of said maximum fill level has been reached and when a predetermined filling time has been exceeded, wherein an error message is issued to a user when said filling time has been exceeded without reaching said maximum fill level.

* * * * *